US005340457A

United States Patent [19]

Ford et al.

[11] Patent Number: 5,340,457

[45] Date of Patent: Aug. 23, 1994

[54] ELECTROLYTIC CELL

[75] Inventors: James M. Ford; David W. Cawlfield, both of Cleveland, Tenn.

[73] Assignee: Olin Corporation, Cheshire, Conn.

[21] Appl. No.: 53,743

[22] Filed: Apr. 29, 1993

[51] Int. Cl.[5] ..... C25B 9/00

[52] U.S. Cl. ..... 204/252; 204/253; 204/289; 204/279

[58] Field of Search ..... 204/252, 253–258, 204/263–266, 267–270, 289, 279

[56] References Cited

U.S. PATENT DOCUMENTS

| | | | |
|---|---|---|---|
| 4,013,525 | 3/1977 | Emsley | 204/98 |
| 4,029,565 | 6/1977 | Bender et al. | 204/256 |
| 4,115,236 | 9/1978 | Smura | 204/254 |
| 4,121,990 | 10/1978 | Boulton | 204/258 |
| 4,204,939 | 5/1980 | Boulton et al. | 204/258 |
| 4,252,628 | 2/1981 | Boulton et al. | 204/257 |
| 4,256,551 | 3/1981 | Cliff et al. | 204/98 |
| 4,309,264 | 1/1982 | Bender et al. | 204/256 |
| 4,430,179 | 2/1984 | Ford | 204/128 |
| 4,464,243 | 8/1984 | Woolhouse | 204/257 |
| 4,571,288 | 2/1986 | Boulton | 204/98 |
| 4,784,735 | 11/1988 | Sorenson | 204/98 |
| 4,822,461 | 4/1989 | Brattan et al. | 204/98 |
| 5,041,196 | 8/1991 | Cawlfield et al. | 204/101 |
| 5,064,514 | 11/1991 | Cawlfield et al. | 204/103 |
| 5,084,149 | 1/1992 | Kaczur et al. | 204/101 |
| 5,108,560 | 4/1992 | Cawlfield et al. | 204/103 |

*Primary Examiner*—Donald R. Valentine
*Attorney, Agent, or Firm*—Dale L. Carlson

[57] ABSTRACT

An electrolytic cell construction in which the cell includes at least one anode and cathode, and a separator therebetween held under a compressive force by a frame assembly. The anodes and cathode are provided with a portion for electrical connection to an electric connector plate. The electric connector plate is positioned in contact with a respective anode and cathode. The compressive force of the frame assembly which holds the components of the cell in compression to provide a fluid tight seal simultaneously serves to apply a force between the electrical connector plates and their respective anode or cathode to hold the electrical connector plates in contact therewith. Preferably spring means are provided for biasing the electrical connector plates and the portions of the anode and cathode for connection to the plate into engagement with each other. The spring means is compressed simultaneously with the frame assembly placing the components of the cell under compression so that the spring means forces the anode and cathode electrical connection portions into contact with their respective electrical connector plate.

17 Claims, 3 Drawing Sheets

ELECTROLYTIC CELL

BACKGROUND OF THE INVENTION

This invention relates generally to electrolytic cells, and more particularly, to such cells having an improved electrical connection.

Electrolytic cells are well known and generally comprise at least one anode and cathode with each anode being separated from an adjacent cathode by a separator such as a diaphragm or membrane which divides the electrolytic cell into anode and cathode compartments. Recent cell designs, as for example that shown in copending U.S. patent application Ser. No. 970,500, filed Nov. 2, 1992, by D. W. Cawlfield, utilize very thin anolyte and catholyte compartments for the circulation of the electrolytes at specified velocities and flow. Such designs also utilize relatively thin anode and cathode back plates in order to control and minimize expensive metal costs. These cell components are forced together in order to compress sealing means that prevent electrolyte contained in the anolyte and catholyte compartments from leaking out.

In keeping with the desire to minimize expense, it is also desirable to minimize the width and thickness of the expensive metal anode and cathode back plate extensions provided for the connection of an electrical distribution connector to a respective anode or cathode. These relatively thin cell components create a problem of achieving the required electric connection in the very closely confined spacial gap between the electrode element extensions and other cell components.

One possible solution to the problem of attaching an electrical connector within the closely confined spacial gap is the welding-in of hi-metallic junction members. However, such members are expensive to buy and fabricate into a joint. The use of small screws to connect the electric power connector is not a satisfactory solution as a suitable electric junction force is not reliably achieved.

SUMMARY OF THE INVENTION

In view of the above, it is an object of the present invention to provide an improved electrolytic cell design having an improved connection of the electrical power connectors to the electrode elements.

More particularly, it is an object of the present invention to provide an electrolytic cell design utilizing electrodes with back plates and having an improved connection between the back plates and the electrical power connector.

It is a more specific object of the present invention to provide an improved electrolytic cell having closely spaced electrode back plates used as carriers into the active electrodes and having an improved means for connecting the electrical power connector to such back plates.

These and other objects are advantages of the present invention and may be achieved through the provision of an electrolytic cell comprising spaced frame members, cell components positioned between said frame members and including electrodes. The electrodes may include a portion for connection to an electrical power connection. Clamping means are provided for clamping the spaced frame members together to exert a compressive force on the components of the cell while simultaneously providing a force holding the electrical power connection in electrical contact with the portion of the electrodes.

BRIEF DESCRIPTION OF THE DRAWINGS

The present invention may be better understood by reference to the following detailed description and to the accompanying drawings in which.

DETAILED DESCRIPTION

Figure 2:
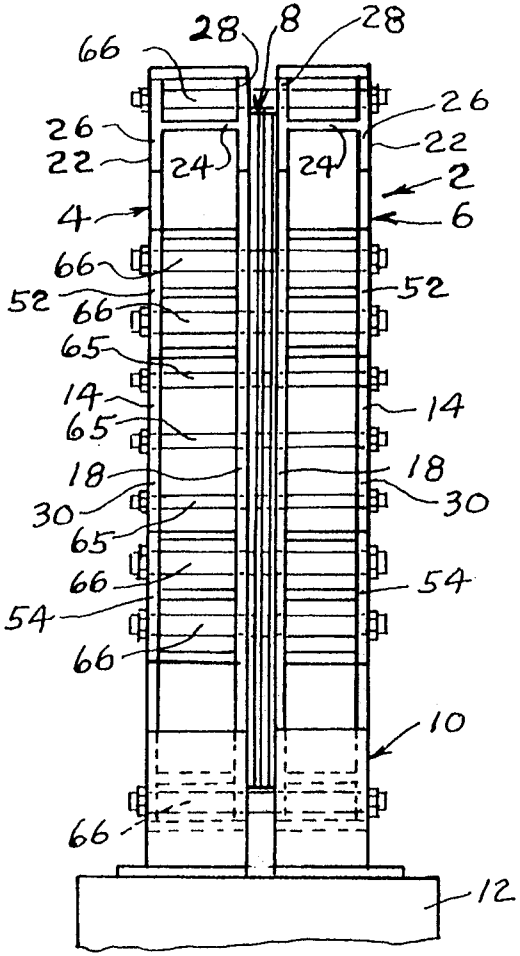
FIG. 2 is an end view of the frame assembly of FIG. 1 schematically showing the cell components positioned therein.
Figure 1:
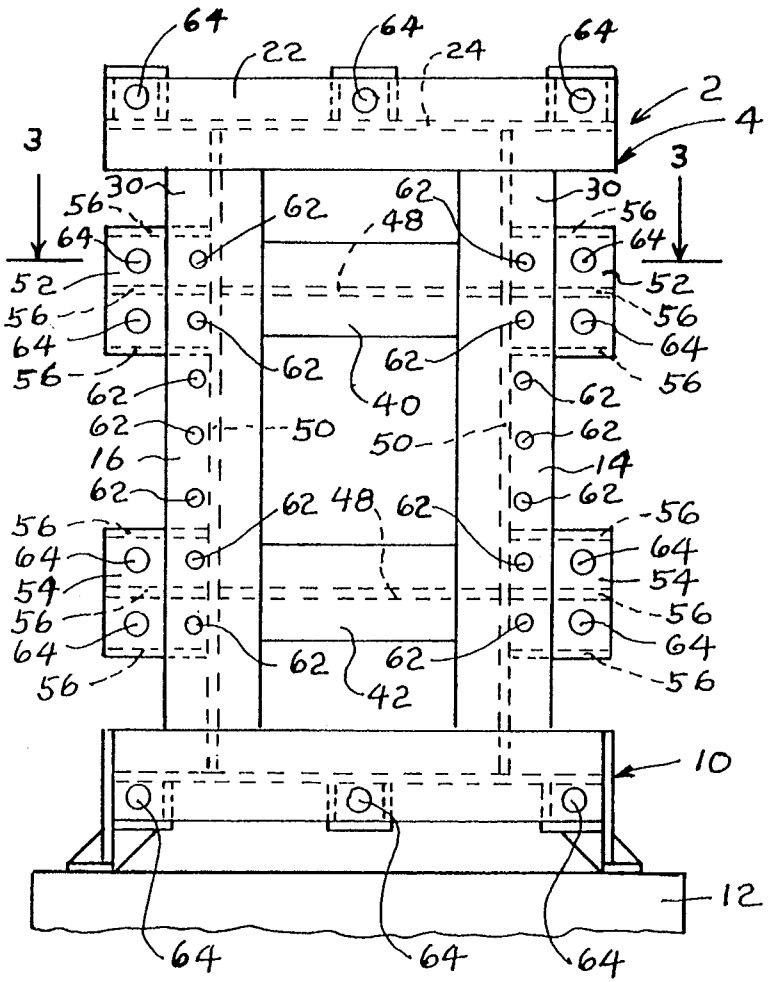
FIG. 1 is a vertical side view of the frame assembly for an electrolytic cell in accordance with the present invention.

FIGS. 1 and 2 show a frame assembly 2 of a cell in accordance with the present invention. The frame assembly 2 includes two spaced frame units 4 and 6 between which are positioned the cell components 8.

Each frame unit 4 and 6 of the frame assembly 2 includes a base 10 resting on a suitable platform 12. Two I-beam members 14 and 16 extend vertically upwardly from the base 10 of each frame unit 4 and 6 with their inner flanges 18 positioned in a plane parallel to the width of the cell forming a face 20 in contact with the cell components 8. The upper ends of the I-beam member 14 and 16 of each frame unit 4 and 6 are connected by a horizontally extending I-beam member 22. Each I-beam member 22 is positioned with its web 24 in a horizontal plane and its flanges 26 and 28 disposed in a vertical plane and attached to the upper ends of the inner flanges 18 and an outer flange 30 respectively of the vertically extending I-beam members 14 and 16 as shown.

Each frame unit 4 and 6 also include upper and lower I-beam cross supports 40 and 42 extending horizontally between the two vertically extending I-beams 14 and 16. Each of the I-beams 40 and 42 have their inner and outer flanges 44 and 46 extending in a vertical plane and attached to the inner and outer flanges 18 and 30 respectively of the vertically extending I-beams 14 and 16. The web 48 of each of the horizontally extending I-beams 40 and 42 extends in a horizontal plane and projects into the I-beams 14 and 16 in the engagement with their web portions 50.

Figure 3:
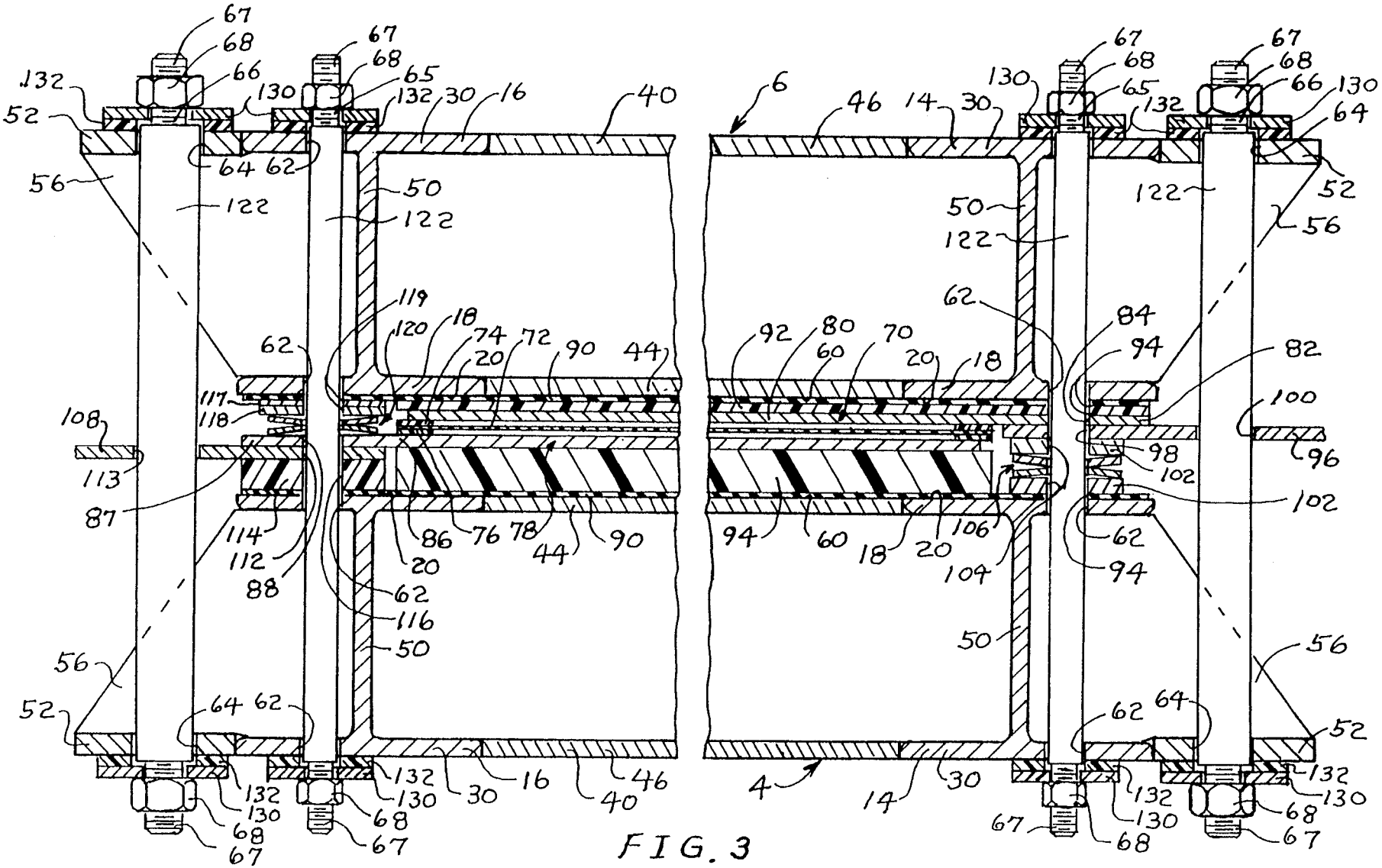
FIG. 3 is a sectional view taken on the lines 3—3 of FIG. 1 and showing the components of the electrolytic cell positioned within the frame assembly.

An upper vertically extending plate member 52 is attached to the upper portion of each of the I-beam members 14 and 16 of both units 4 and 6. The plate member 52 is attached to the outside edge of the outer flange 30 of each I-beam member 14 and 16. Similarly, a lower vertically extending plate member 54 is attached to the outside edge of the outer flange 30 at a lower portion of each I-beam member 14 and 16. Three steel reinforcing plates 56 extend in a horizontal plane from the inner face of each of the plate members 52 and 54 and the inner face of the outer portion of the outer flange 30 of the I-beam member 14 and 16 to the web 58 and inner flange 18 of each of the I-beams 14 and 16 as shown in FIG. 3. The three plates 56 associated with each of the plate members 52 and 54 are spaced vertically such that one plate has its upper surface in a vertical plane with the upper edge of the plate member 52, a second plate member 52 has its bottom surface in a vertical plane with the lower edge of the plate member 52 or 54 and a third positioned equal distance between the two.

As shown particularly in FIGS. 2 and 3, the components 8 of the cell are positioned between the faces 20 formed by the inner surface of the inner flanges 18 of the I-beam member 14 and 16 and the face 60 formed by the inner surface of the inner flanges 44 of the I-beam 14 and 16. The outer portion of each flange 18 and 30 of each I-beam member 14 and 16 of each frame unit 4 and 6 includes a set of vertically spaced apertures 62. An aperture 62 of one set in the outer flange 30 of the I beam member 14 of the frame unit 4 is coaxially with a respective aperture 62 in the inner flange 18 of that I-beam member 14 and also a respective aperture 62 in the inner and outer flanges 18 and 30 of the I-beam member 14 of the outer frame unit 6. Similarly, an aperture 62 in the outer flange 30 of the I-beam member 16 of the frame unit 4 is coaxial with respective apertures in the inner flange 18 and out inner and outer flanges 18 and 30 of the I-beam member 16 of the outer frame unit 6. The plate member 52 and 54, as well as the base 10 and horizontally extending I-beam 22 of each frame unit 4 and 6, are also provided with horizontally aligned apertures 64 as shown. The coaxial apertures 62 provide openings for rod members 65 which are optional and may serve as alignment means. Rod members 66 extend horizontally between the two frame units 4 and 6 in apertures 64. The rod members 65 and 66 are provided with threaded end portions 67 to receive nuts 68. The rod members 66 and their associated nuts 68 provide clamping means for drawing the two frame units together to exert a compressive force on the cell components 8 positioned therebetween.

The components of the cell may be of type particularly shown and described in the above mentioned U.S. patent application Ser. No. 07/970,500. In general, the components of the cell include an anode 70 separated from a membrane or separator 72 by a gasket 74 to form an anode compartment. A gasket 76 is positioned on the other side of the membrane 74 with a cathode 78 positioned against the opposite side of the gasket 76 to form a cathode compartment.

The anode may include an anode plate 80 which may have an anode material (not shown for sake of clarity) attached to the surface of the anode plate 80 facing the membrane 72. Depending upon the particular electrochemical process for which the cell is to use, such anode material may be porous, being formed, for example, from a coated wire or expanded mesh or fiber in a structure which allows the anolyte to flow in all three dimensions. Materials which may be employed in the anode structures include platinum, platinum group metals, platinum group metal oxides, metal substrates coated with platinum or platinum group metals, lead dioxide and metal substrates coated with lead dioxides. Suitable metal substrates include the valve metals such as titanium and niobium among others. The anode plate may be fabricated from a suitable electrically conductive material which is resistant to the electrolyte such as titanium or niobium or such materials as the platinum group metals, platinum group metals coated on a substrate or valve metals such as titanium or niobium. The anode material may be attached to the anode plate 80 by any suitable means such as spot welding or the like.

The anode plate 80 includes a tab portion 82 projecting from the side edges of the gaskets 74 and 76 and membrane 72 to the right as viewed in FIG. 3. Such tab portion 82 extends the entire vertical height of the anode plate 80 and forms a means for connecting the electrical power connector to the anode. The tab portion 82 includes a series of apertures 84 adapted to align with the aperture 62 in the I-beam member 14 of the frame units 4 and 6.

The cathode 78 also includes a cathode plate 86. The cathode plate 86, depending upon the particular electrochemical process for which the cell is to be used, may have a cathode material (not shown for the sake of clarity) attached to its surface facing the membrane 72. Typical materials which may be used for the cathode plate 86 include nickel and alloys thereof, titanium or other valve metals and alloys thereof, which may optionally be plated with platinum or platinum group metals. The cathode material may be a mesh type structure fabricated from suitable materials and may, for example, be a Hastelloy® C-22 structure having an outer 100-mesh screen layer support supported on a coarse (6 lines/inch) inner mesh layer and spot welded to the cathode plate.

The cathode plate 86 includes a elongated tab portion 87 projecting from the side edge of the gaskets 74 and 76 and membrane 72 to the left as viewed in FIG. 3. The tab portion 87 extends the entire vertical height of the cathode plate 86 and forms a means for connecting an electrical power connector to the cathode plate 86. The tab portion 86 includes a series of apertures 88 adapted to align with the apertures 62 in the I-beam members 16 of the frame units 4 and 6.

The material of the separator or membrane 72 will also depend on the particular electrochemical process. Generally, it may comprise a cation exchange membrane. Such membranes are well-known to contain fixed anionic groups that permit intrusion and exchange of cations and exclude anions from an external source. Resins which may be used to produce membranes include, for example, fluorocarbons, vinyl compounds, polyolefins, hydrocarbons, and copolymers thereof. An example of a suitable membrane is a cation permeable fluid polymer base membrane sold under the trademark Nafion® 117 by E.I. Dupont De Nemours & Company.

The material of the gaskets 74 and 76 may be a chemical-resistant gasket material. Suitable materials include rubber-type materials such as EPDM, a fluoropolymer, or a fluoropolymer containing composite. Other suitable types of gasket materials include flexible foam types made from polyethylene, polypropylene, polyvinyl chloride, and fluoropolymers.

Further by way of example, the thickness of the anode and cathode plates 80 and 86 is generally from about 1 millimeter to about 25 millimeters and optimized to obtain a minimum total of operating and installation costs. The width of the plate may be typically one-half meter and normally no larger than about one meter. It has been found that a length to width ratio of from about 1.5:1 to about 8:1 and preferably about 2:1 to about 4:1 is desirable.

The components 8 of the cell are positioned between the two frame assembly units as shown in FIG. 3. An optional sheet 90 of rubber or other suitable anti-corrosive nonconducting material is positioned against the faces of each unit 4 and 6 and of the frame assembly 2. An insulating material 92 such as PVDF is positioned between the rubber sheet 90 and the anode plate 70. Another pad of insulating material 94 is positioned between the rubber sheet 90 and the cathode plate 86. This pad 94 provides a means for connecting electrolyte flow to the cell. As will be noted from FIG. 3, the gaskets 74 and 76 and membrane 72 are positioned widthwise within the frame assembly between the planes passing through the webs of the right hand and left hand vertically extending I-beams 14 and 16.

As shown in FIG. 3, the tab portion 82 of the anode plate 80 extends beyond the gaskets 74 and 76 and membrane 72 in a horizontal direction to a point adjacent the outside edges of the flanges of the vertically extending I-beams 14. The rubber sheet 90 and insulation material 92 also project horizontally from the side edges of the gaskets 74 and 76 and membrane 72 and are provided with apertures 94 in which are coaxial with respective aperture 84 in the anode plate tab portion 82.

An electrical power connection in the form of an electrical connector plate 96, preferably of copper, is positioned against the elongated tab portion 82 of the anode plate 80. The connector plate 96 has a vertical height such that it extends vertically from a point slightly below the lowest aperture 62 in the I-beam 14 to a point slightly above the upper most aperture 62. The connector plate 96 has a series of apertures 98 aligned with the apertures 84 in the tab portion 82 and a series of apertures 100 aligned with the apertures 64 in the plate members 52 and 54 attached to the I-beam member 14. The connector plate 96 has a surface positioned against the surface of the tab portion 82 facing the gaskets 74 and membrane 72. A pair of spacer bars 102 having apertures 104 therethrough coaxial with the apertures in the tab portion 82 of the anode plates 80 is positioned on the side of the connector plate 96 opposite the tab portion 82. The spacer bars 104 are separated by spring means 106. Such spring means may be disc spring washers, Belleville washers, coil springs, or other spring means adapted to be placed under compression when the frame units are tightened together to force the connector plate 96 into engagement with the tab portion 82 of the anode plate 80.

An electrical power connection for the cathode in the form of an electrical connector plate 108 has a surface positioned against the surface of the tab portion 87 of the cathode plate 86 opposite to the surface thereof facing the gaskets 74 and membrane 72. The connector plate 108 has a series of apertures 112 therein coaxial with the apertures 88 in the tab portion 87 of the cathode plate 86 and a plurality of apertures 113 aligned with the aperture 64 in the plate member 52 and 54 attached to the I-beam member 16. The connector plate 108 is spaced from the rubber sheet 90 positioned against I-beam member 16 of frame unit 4 by a spacing member 114 of Haysite or other suitable electrically insulating material. The spacing member 114 has an aperture 116 therethrough coaxial with the apertures 88 in the tab portion 86 of the cathode plate 84. A pair of spacer bars 117 and 118, having aperture 119 therein, is provided on the other side of the tab portion 88 of the cathode plate and are positioned against the rubber sheet 90 abutting frame unit 6. Spring means 120 is positioned between the inner most spacer bar 118 and the tab portion 86 of the cathode plate 84. Such spring means are similar to the spring means associated with the tab portion 82 of the anode plate 80 and may include the spring washers, Belleville washers, coil spring, or other suitable means adapted to be placed under compression when the frame units 4 and 6 are tightened together to force the tab portion 86 of the cathode plate 84 against the electrical connector plate.

In assembly, the cell components are positioned between the two frame units. If desired, a plastic or rubber electrically insulating tube 122 may be inserted through the various aligned apertures in the anode and cathode tab portions , spacer bars, spacer pads and connector plate as shown in FIG. 3 to aid in the assembly of the components and help align the aperture of those membranes with the apertures in the frame assembly 2.

The rod members 65 are inserted through the tubes 122 so that, on the left hand side is viewed in FIG. 3, the rods 65 extend through the aperture 62 in the inner and outer flanges 18 and 30 of the I-beam members 16 of both frame units 4 and spacer bars 116 and 118, spring means 120, the tab portion 88 of the cathode plate 86, the cathode electrical connector plate 108 and spacing member 112. On the right hand side as viewed in FIG. 3, the rod members 65 extend through the apertures 62 in the inner and outer flanges 18 and 30 of the I-beam members 14 of both frame units 4 and 6, the rubber sheets 90, the pair of spacer bar 104, the spring means 106, the anode electrical connector plate 96, the tab portion 82 of the anode plate 80 and the insulating material 92. These rod members 65 are optional and are used to aid in alignment.

Rod members 66 are inserted through the insulating tubes 122 in the coaxial apertures 64 in the plate members 52 and 54, electrical connectors 96 and 108 as well as through the apertures in the base 10 and horizontal I-beam 22 of both frame units 4 and 6. Nuts 68 are provided on the threaded end portions 67 of the rod members 65 and 66 with a steel washer 130 positioned against each of the nuts 66 and a gasket 132 positioned against the inner face of each washer 130. The nuts 68 on rods 66 are tightened to compress the cell components together to compress the gaskets 74 and 76 and other components into a sealing relationship to prevent electrolyte leakage and also force the electrical connector plates into tight electrical contact with its respective anode or cathode tab portion. The tightening of the cell may utilize an apparatus as described in U.S. Pat. No. 4,430,179 to achieve a substantially uniform pressure to compress the cell and assemble it in a fluid tight manner.

Such a tightening apparatus is desirable as it can require as much as 70 tons of force to be applied to the cell to provide proper compression to achieve a fluid tight arrangement.

As will be noted, with the arrangement described above, as the the two frame units 4 and 6 are being forced together by the tightening of the nuts 68 on the rods 66, in addition to a compressive force being applied to the components 8 of the cell positioned between the two faces of the frame units 4 and 6, this tightening force also tends to compress the spring means associated with each of the electrical connector plates. This compression results in a force which tends to hold the electrical connector plates against the tab portion of a respective anode or cathode plate to ensure good contact and electrical continuity. Thus, the present invention takes advantage of the compressive force applied to the components of the cell assembly to also ensure good electrical conductivity between the electrical connector plates and anode and cathode tab portions.

The surface of each of the anode and cathode tab portions 82 and 87 respectively that are in engagement with an associated electrical connector plate 96 or 108 may be plated. Such plating is preferably tin or copper in the case where the tab portion being is nickel or a nickel alloy, and platinum or a platinum group material in the case where the tab portion is titanium.

Although FIG. 3 shows a cell with a single cathode and anode, the present invention has particular utility with cells utilizing a plurality of anodes and cathodes which provide a plurality of anode and cathode compartments. While an example of such a cell arrangement is shown and described in the above-mentioned copending U.S. application Ser. No. 08/970,500, FIG. 4 shows the present invention applied to such multi-compartment cells as well as a modification of the spring means.

Figure 4:
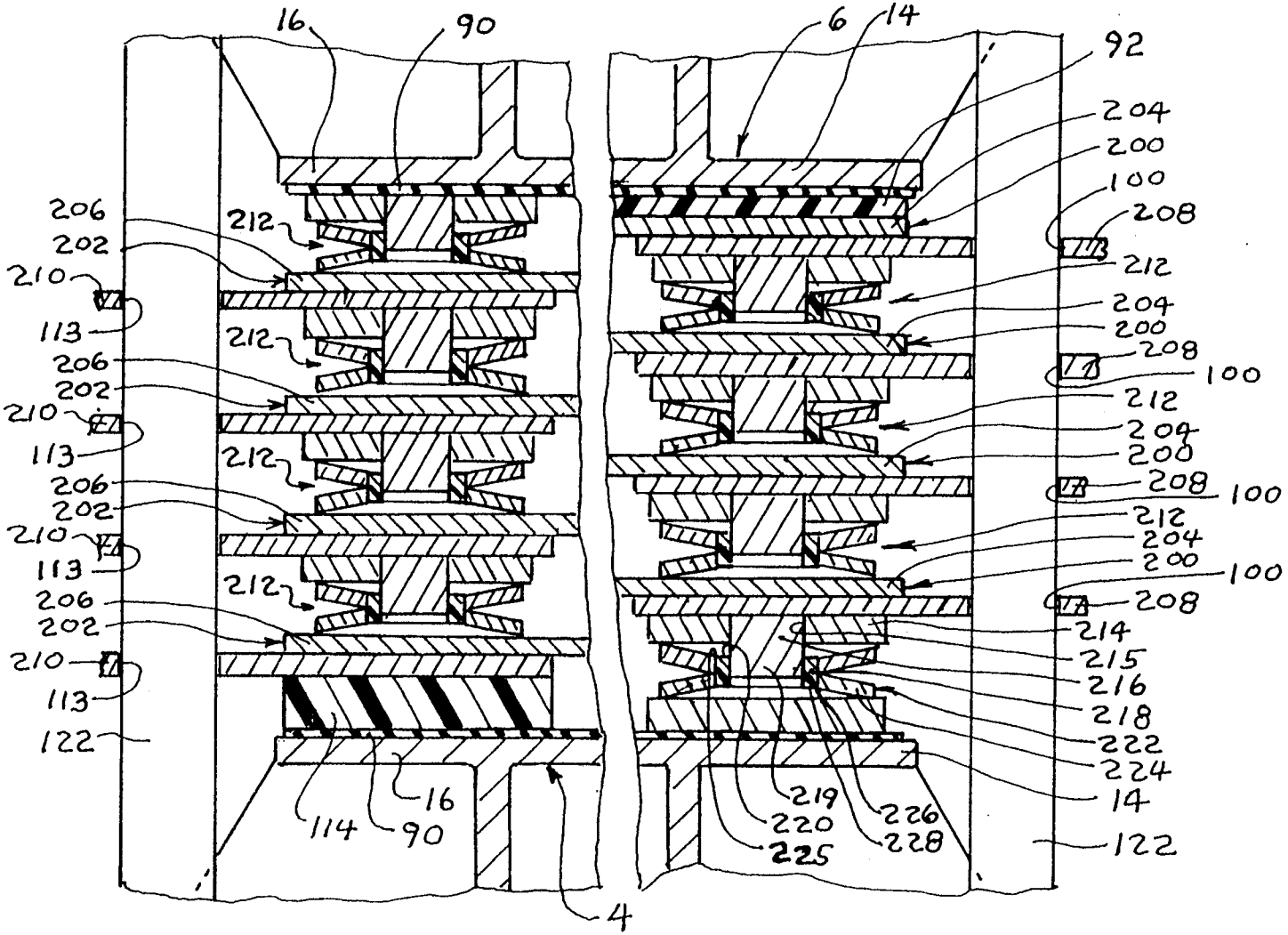
FIG. 4 is a partial horizontal sectional view showing a modification of the present invention applied to a cell having a plurality of anodes and cathodes.

As shown in FIG. 4, the cell comprises a plurality of anodes 200 and cathodes 202 similar to the anode 70 and cathode 78 shown in FIG. 3. A membrane or separator with gaskets on either side (not shown) are provided between adjacent anodes 200 and cathode 202 in a manner as shown in FIG. 3, thereby forming a plurality of anode and cathode components positioned between the frame units 4 and 6.

Each anode 200 has a tab portion 204 extending from the side edges of the cathode 202 in one direction. Each cathode 202 has a tab portion 206 extending from the side edges of the anode 200 in the direction opposite to that of the tab portion 204 of the anodes 200. Each of the tab portions 204 and 206 provide a surface against which a surface of an associated anode or cathode electrical connector plate 208 and 210 bears.

Spring means 212 is positioned between each anode tab portion 204 and its associated electrical connector plate 208 and an adjacent anode tab portion 204 and associated connector plate 208. Similar spring means 212 is also positioned between each cathode tab portion 202 and associated electrical connector plate 210 and an adjacent cathode tab portion 202 and associated connector plate 210.

At the side of the cell where the cathode 202 is closer to the frame means 4, the spring means 212 is interposed between a spacer 213 positioned against the rubber sheet 90 positioned against the frame unit 4 and the first anode connector plate 208. On the other side of the cell, where the anode 200 is positioned closer to the frame unit 6 than the cathode 206, the spring means 212 is positioned between the rubber sheet 90 lying against the frame unit 6 and the first cathode 202 and associated electrical connector plate 210 on that side.

Each of the spring means 212 according to the embodiment shown in FIG. 4 may comprise a vertically extending spacer plate 214 of steel or other hard material. Each spacer plate has a plurality of vertically aligned apertures 215 therein having spacing similar to the apertures 62 in the I-beams of the frame members shown in FIG. 1. A short rod or plug 216 is press fit into each aperture and has one end extending from one side of the plate 214. The other end of the rod or plug 216 is flush with the other side of the plate 214.

A sleeve 218 of plastic or other suitable material is frictionally retained on the extending portion 214 of the rod or plug 216 and has its rearward edge 220 spaced from the plate 214.

A spring member 222 is mounted on the sleeve 218. The spring member 222 preferably comprises disc spring members or washers 224.

The washers have their forward and rearward inner edges 225 and 226 flush with the forward edge 228 and rearward edge 220 of the sleeve 218 respectively.

With the spring arrangement of FIG. 4, there is no need for the apertures 84 and 88 in the tab portions of the anodes and cathodes as well as the apertures 62 in the frame units 2 and 4 as shown in FIG. 1 and 3. Rather, each I-beam 14 and 16 may be provided with two apertures, one positioned above the point where the upper aperture 62 would be located and one positioned below the point where the lower aperture 62 would be located. The upper and lower portions of each spacer plate 214 and the anode tab portion and cathode tab portion would also have apertures in alignment with those apertures in the I-beam 14 and 16 through which alignment means may be inserted. The frame units 4 and 6 would still include the apertures 64 in the plate members 52 and 54 through which sleeve and rods are inserted to provide the tightening means as explained above in connection with FIG. 1–3. Such rods will also pass through the apertures 100 and 113 in the anode and cathode connector plates 208 and 210.

In the arrangement shown in FIG. 4, when the frame units 4 and 6 are tightened together, the sleeve 218 can move on the rod or plug 216 toward the spacer plate 214 as the Belleville washers are compressed, thereby permitting the washers 224 to collapse and exert a force biasing the connector plates 208 and 210 against the surface of the tab portions 204 and 206 of their associated anodes 200 and cathodes 202. Also, with the arrangement shown in FIG. 4, the spring 222 itself bears directly against the hard metallic spacer plate 214 and the relatively hard metallic anode and cathode tab portions 204 and 206. There is no direct engagement of the Belleville washer 224 against the relative soft copper material of the connector plates 208 and 210.

While the invention has been described above with reference to a specific embodiment thereof, it is apparent that many changes, modifications, and variations can be made without departing from the concept disclosed herein. Accordingly, it is intended to embrace all such changed, modifications, and variations that fall within the spirit and broad scope of the appended claims. All patents and applications cited herein are incorporate by reference in their entirety.

What is claimed is:

1. An electrolytic cell comprising:

a. spaced frame units;

b. cell components including an anode, a cathode, and separator positioned between said frame units, said anode and cathode each having a connector plate engaging portion for engagement with an electrical connector plate;

c. an electrical connector plate associated with each anode and cathode, d. spring means for biasing one of either said electrical connector plate or said connector plate engaging portion of an associated anode or cathode into engagement with the other, e. clamping means for clamping the frame units together to exert a compressive force on the cell components while simultaneously compressing said spring means so said spring means forces said connector plate engaging portion and an associated electrical connector plate into electrical engagement.

2. The cell of claim 1 wherein said clamping means includes rod members extending between said frame units and tightening means on said rod members for tightening said frame units together.

3. The electrolytic cell of claim 1 wherein said connector plate engaging portion of said anode includes a tab portion extending to one side of said cell beyond the side edges of said cathode and said separator, said electrical connector plate having a surface in engagement with said tab portion, and said spring means biasing said tab portion and said electrical connector plate into engagement when said clamping means is tightened.

4. The electrolytic cell of claim 3 wherein said clamping means includes rod means extending between said frame units and tightening means on said rod means for tightening said frame means together.

5. The electrolyte cell of claim 4 wherein said tab portion and said electrical connector plate have apertures therein for passage of alignment means therethrough.

6. The electrolytic cell of claim 5 wherein at least some of said alignment means passing through said anode tab portion pass through said spring means.

7. The electrolytic cell of claim 3 wherein said connector plate engaging portion of said cathode includes a tab portion extending beyond the side edges of said anode and separator on the side of the cell opposite said tab portion of said anode.

8. The electrolytic cell of claim 7 wherein said clamping means include rod means extending between said frame units and tightening means on said rod means for tightening said frame units together, said tab portions of said anode and said anode electrical connector plate having a series of coaxial apertures therein for the passage of alignment means therethrough, and said cathode electrical connector plate and said tab portion of said cathode having coaxial apertures therein for the passage of alignment means therethrough.

9. The electrolytic cell of claim 8 wherein at least some of said alignment means pass through said spring means.

10. The cell of claim 9 wherein said clamping means includes rod members extending between said frame units and tightening means on said rod members for tightening said frame units together.

11. An electrolytic cell comprising:

a. spaced frame units;

b. cell components positioned between said frame units and including a plurality of anodes and cathodes having a separator positioned therebetween, each said anode and cathode having a connector plate engaging portion;

c. an electrical connector plate associated with each anode and cathode;

d. spring means interposed between each anode and between each cathode and biasing said electrical connector plate into engagement with its associated anode or cathode connector plate engaging portion; and e. clamping means for clamping the frame units together to exert a compressive force on the cell components while simultaneously compressing said spring means so said spring means forces said electrical connector plate and its associated anode and cathode connector plate engaging portion into electrical engagement.

12. The electrolytic cell of claim 11 wherein said connector plate engaging portion of each said anode includes a tab portion on each anode extending to one side of said cell beyond the side edges of said cathode and separator and said connector plate engaging portion of said cathodes includes a tab portion on each cathode extending beyond the side edge of said anode and separator to the side of said cell opposite the tab portion of said anode, said electrical connector plate having a surface in engagement with a tab portion of its associated anode or cathode.

13. The electrolytic cell of claim 12 wherein said spring means includes a spacer plate and a spring member, said spacer plate being interposed between said spring member and said electrical connector plate.

14. The electrolytic cell of claim 12 wherein at least some of said tab portions are nickel or a nickel alloy, the surface of said tab portion of nickel or nickel alloy in contact with associated electrical connector plate having a plating therein of a material selected from the group consisting of copper, tin, or alloys thereof.

15. The electrolytic cell of claim 12 wherein at least some of said tab portions are titanium, the surface of said tab portions of titanium in contact with an associated electrical connector plate having a plating thereon of a material selected from the group consisting of platinum and platinum group metals.

16. The electrolytic cell of claim 12 wherein said spring means include a spring assembly associated with each anode or cathode tab portion and its associated electrical connector plate, said spring assembly including a vertically extending spacer plate having a series of vertically aligned apertures therein, a plug mounted in each said aperture and extending therefrom, a sleeve frictionally retained on said plug, and a spring member mounted on said sleeve.

17. An electrolytic cell comprising:

a. spaced frame units;

b. cell components positioned between said frame units and including a plurality of anodes and cathodes having a separator positioned therebetween, each said anode and cathode having a connector plate engaging portion;

c. an electrical connector plate associated with each anode and cathode;

d. spring means interposed between each anode and between each cathode and biasing said electrical connector plate into engagement with its associated anode or cathode connector plate engaging portion; and e. clamping means for clamping the frame units together to exert a compressive force on the cell components while simultaneously compressing said spring means so said spring means forces said electrical connector plate and its associated anode and cathode connector plate engaging portion into electrical engagement;

wherein said connector plate engaging portion of each said anode includes a tab portion on each anode extending to one side of said cell beyond the side edges of said cathode and separator and said connector plate engaging portion of said cathodes includes a tab portion on each cathode extending beyond the side edge of said anode and separator to the side of said cell opposite the tab portion of said anode, said electrical connector plate having a surface in engagement with a tab portion of its associated anode or cathode, wherein said spring means includes a spacer plate and a spring member, said spacer plate being interposed between said spring member and said electrical connector plate, wherein said spring member comprises washers, said washers being interposed between said spacer plate and an adjacent anode or cathode tab portion, and wherein said electrical connector plates are copper and said spacer plates are steel.

* * * * *